US010138626B1

(12) United States Patent
Cates

(10) Patent No.: US 10,138,626 B1
(45) Date of Patent: Nov. 27, 2018

(54) METHOD AND APPARATUS FOR REPAIRING A TILT WALL CONSTRUCTION

(71) Applicant: PATENTS OF TOMBALL, LLC, Houston, TX (US)

(72) Inventor: Christopher H. Cates, Houston, TX (US)

(73) Assignee: PATENTS OF TOMBALL, LLC, Houston, TX (US)

( * ) Notice: Subject to any disclaimer, the term of this patent is extended or adjusted under 35 U.S.C. 154(b) by 0 days.

(21) Appl. No.: 15/699,017

(22) Filed: Sep. 8, 2017

(51) Int. Cl.

| | |
|---|---|
| ***E04H 12/20*** | (2006.01) |
| ***E04B 1/38*** | (2006.01) |
| ***E04B 1/35*** | (2006.01) |
| *E04B 2/56* | (2006.01) |
| *E02D 5/54* | (2006.01) |

(52) U.S. Cl.
CPC ..... *E04B 1/355* (2013.01); *E02D 5/54* (2013.01); *E04B 2/56* (2013.01)

(58) Field of Classification Search
CPC ..... E04B 1/355; E04B 2/56; E02D 5/54
USPC ..... 52/79.9, 253, 741.15
See application file for complete search history.

(56) References Cited

U.S. PATENT DOCUMENTS 1,811,217 A * 6/1931 Spaugh ..... E04H 17/08 52/125.6
3,606,231 A * 9/1971 Kilborn ..... B61D 45/005 248/354.3
3,750,349 A * 8/1973 Deike ..... B60P 3/32 248/354.3
3,798,856 A * 3/1974 Gloskowski ..... E04G 21/26 248/354.3
4,068,427 A * 1/1978 Camardo ..... E04G 21/26 52/127.2
4,083,156 A * 4/1978 Tye ..... E04G 21/26 248/354.5
4,872,634 A 10/1989 Gillaspy et al.
4,995,204 A 2/1991 Kelso
5,368,416 A * 11/1994 Cataldo ..... E01F 8/0011 405/258.1
5,404,685 A * 4/1995 Collins ..... E04C 2/205 256/19
5,428,926 A * 7/1995 Melfi ..... E01F 8/0017 52/247
5,588,786 A * 12/1996 House ..... E01F 8/0011 405/284
5,609,005 A 3/1997 Schierloh et al.
5,619,829 A * 4/1997 Tan ..... E01F 7/06 404/9

(Continued)

*Primary Examiner* — Charles A Fox
*Assistant Examiner* — James J Buckle, Jr.
(74) *Attorney, Agent, or Firm* — Egbert Law Offices, PLLC

(57) ABSTRACT

A method of repairing a tilt wall construction includes affixing a fixture at a bottom of the wall, installing a piling into the earth directly below the fixture, forming a support member having a link corresponding to a distance between the fixture and a head the piling, and affixing the support member to the fixture and to the head such that the piling supports the wall. The fixture is an angle member that is anchored to the wall. A plate is affixed onto a top surface of the head of the piling. The support member can include a pair of steel pipes that are welded at one end to the plate and an opposite end welded to the angle member.

12 Claims, 4 Drawing Sheets

(56) References Cited

U.S. PATENT DOCUMENTS

| | | | | |
|---|---|---|---|---|
| 5,809,716 | A * | 9/1998 | Elmore | E01C 3/00 405/284 |
| 5,829,220 | A * | 11/1998 | Zumeta | E02D 35/00 52/741.13 |
| 5,956,906 | A * | 9/1999 | Berich | E04G 21/26 52/149 |
| 6,230,446 | B1 | 5/2001 | Chalich | |
| 6,256,940 | B1 * | 7/2001 | MacKarvich | E02D 27/02 52/126.6 |
| 6,371,699 | B1 * | 4/2002 | Weinreb | E02D 29/0233 405/262 |
| 7,124,545 | B1 * | 10/2006 | Poma | E04B 1/04 52/293.3 |
| 7,571,577 | B2 * | 8/2009 | Nanayakkara | E04H 9/10 14/73.5 |
| 7,607,264 | B2 * | 10/2009 | Weber | E02D 27/01 248/351 |
| 7,802,409 | B2 * | 9/2010 | Stott | E04H 17/168 52/295 |
| 8,631,628 | B1 * | 1/2014 | Beicker | E04B 1/35 52/742.14 |
| 9,206,580 | B2 * | 12/2015 | Oliver | E02D 27/01 |
| 9,422,734 | B1 * | 8/2016 | Heady | E04G 23/04 |
| 2002/0170253 | A1 * | 11/2002 | MacKarvich | E02D 27/02 52/292 |
| 2003/0066251 | A1 * | 4/2003 | Cusimano | E02D 27/01 52/169.9 |
| 2003/0140578 | A1 * | 7/2003 | Moreno, Jr. | E02D 27/01 52/169.1 |
| 2007/0163189 | A1 * | 7/2007 | Venegas, Jr. | E04H 9/10 52/222 |
| 2007/0234664 | A1 * | 10/2007 | Tucker | E04C 2/06 52/309.12 |

* cited by examiner

METHOD AND APPARATUS FOR REPAIRING A TILT WALL CONSTRUCTION

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates generally to tilt wall construction. More particularly, the present invention relates to methods and apparatus for repairing the tilt wall construction so as to support the tilt wall construction in a proper orientation relative to the earth. Additionally, the present invention relates to methods and apparatus for maintaining the proper support and alignment of walls used in the tilt wall construction.

2. Description of Related Art Including Information Disclosed Under 37 CFR 1.97 and 37 CFR 1.98

In the construction of a concrete building with tilt-up panels, a concrete peripheral foundation and a concrete floor slab are poured. After the forms for the foundation and floor slab are removed, the forms for a series of wall panels are placed on the concrete floor slab. The concrete wall panels are poured directly on the floor slab with a parting agent therebetween. The cured concrete wall panels are then successively tilted to an upright or vertical position and seated on the concrete foundation, usually with continuous grout and plastic shims therebetween to support each wall panel in a precise vertical position. The weight of the concrete wall panels and the roof supported by the wall panels is normally sufficient to maintain the wall panels in their erected vertical positions on the foundation, especially after earth is back filled to cover the foundation and lower edge portions of the wall panels.

In conventional tilt wall construction, concrete piers are formed in the areas adjacent the junctions of adjacent walls. These piers serve to support the weight of the tilt walls once the tilt walls are in their vertical position. Unfortunately, over time, under a variety of circumstances, these piers can fail. In certain circumstances, the piers will sink into a loosely compacted or soft earth formation. In other circumstances, the material of the piers can start to deteriorate so as to weaken the pier and to impair the integrity of the pier.

Once a pier begins to fail, the adjacent walls will move out of alignment. Typically, the edges of such walls will tend to sink as the pier sinks. In other circumstances, the walls can become deflected because of the orientation of the pier. Whenever there is a failure of a pier, a significant repair operation is necessary. In the repair operation, the pier needs to be repoured into a proper configuration. In other circumstances, the failing pier will need to be bolstered in one manner or another. This typically would require the removal of the wall sections during these repair activities. As will be appreciated, this is a very expensive and time-consuming procedure. As such, a need has developed so as to be able to properly repair such tilt wall construction in a convenient, efficient and safe manner.

In prior art techniques of tilt wall construction, the walls are merely supported by the pier. The walls are not directly tied to any other subsurface structure. All of the weight of the wall must be supported by the trusses in the roof of the building so as to maintain the proper vertical orientation. It has been found that, over time, as the walls tend to deflect because of a failing pier, the strength of the connection between the wall and the trusses of the roof of the building are insufficient so as to maintain the tilt wall in a proper position. Whenever these circumstances occur, a very dangerous situation materializes.

Whenever there is a weak connection between the trusses of the roof and the tilt wall, it becomes possible for the wall to fall. Under certain circumstances, the ramming of a wall with a forklift can be sufficient so as to dislodge the wall from its desired position. This not only destroys the integrity of the wall system but also destroys the integrity the trusses associated with the roof structure. As such, the repair of the tilt wall by modifying the roof structure has been found to be ineffective in curing the problems associated with a deteriorating pier condition.

In the past, various patents have issued relating to such tilt wall construction and for the support of walls. For example, U.S. Pat. No. 4,872,634, issued on Oct. 10, 1989 to Gillaspy et al., describes a bracing for tilt-up wall panel. The wall brace includes an elongated main brace that has a mounting bracket at one end for securing to a wall panel and a mounting bracket at the other end for securing to a floor. The wall brace further includes two lateral bracing legs each pivotably coupled at one end to the center of the main brace and each having a mounting bracket at the other end for securing that end of the lateral bracing leg to either the floor or the wall panel.

U.S. Pat. No. 4,995,204, issued on Feb. 26, 1991 to K. J. Kelso, discloses a foundation leveling shim and system. This hydraulic self-contained foundation leveling shim is placed in the upper end of a poured concrete foundation leveling pier before curing. Hydraulic hoses lead to the surface to allow hydraulic fluid to be pumped into and removed from the hydraulic chamber of the shim to raise or lower the foundation on the pier. A plurality of the piers and shims are used to level the foundation of a structure that has settled in unstable soil.

U.S. Pat. No. 5,609,005, issued on Mar. 11, 1997 to Schierloh et al., discloses a foundation connector for tilt-up concrete wall panels. A series of metal connectors each have parallel anchor rods welded to the shorter flange of a right angle section, a cavity defining member attached to the wider flange, and right angle mounting brackets welded to opposite ends of the angle section. The connectors are attached to the base form for tilt-up concrete wall panels and become embedded in the wall panels. After each cured wall panel is erected and seated on a concrete foundation, a hole is drilled on an incline into the foundation through the cavity and a hole within the wider flange of each angle section. A threaded anchor rod is inserted into the hole and secured to the foundation by adhesive. A nut is threaded onto each rod within the tubular member for securing each wall panel to the foundation.

U.S. Pat. No. 6,230,446, issued on May 15, 2001 to B. Chalich, discloses a frangible wedge shim for leveling. This wedge shim is prescored. As such, the shim can be adapted to the size desired.

It is an object of the present invention to provide a method and apparatus for the repair of tilt wall construction which serves to remove a significant amount of weight of the wall from the failing pier.

It is another object of the present invention to provide a method and apparatus for repairing a tilt wall construction which reshapes the tilt wall in conformance with the original pier designs.

It is still another object of the present invention to provide a method and apparatus for repairing a tilt wall construction which avoids potential failures of the tilt wall.

It is still another object of the present invention to provide a method and apparatus for repairing a tilt wall construction which allows the wall to remain in place during repair.

It is still a further object of the present invention to provide a method and apparatus for the repair of tilt wall construction which is easy to carry out, relatively inexpensive and safe.

These and other objects and advantages of the present invention will become apparent from a reading of the attached specification and appended claims.

BRIEF SUMMARY OF THE INVENTION

The present invention is a method of repairing a tilt wall construction comprising the steps of: (1) affixing a fixture at a bottom of the wall; (2) installing a piling into the earth directly below the fixture; (3) forming a support member having a length corresponding to a distance between the fixture and a head of the piling; and (4) affixing the support member to the fixture and to the head of the piling such that the piling supports the wall.

In the present invention, the fixture is an angle member. The method includes the step of anchoring the angle member to the wall such that one surface of the angle member overlies a portion of a side of the wall adjacent the bottom of the wall and such that another surface of the angle member underlies a portion of the bottom of the wall. A plate is affixed onto a top surface of the head the piling. The piling has a cable extending therethrough. The plate is affixed by a locking member secured to the cable.

The step of affixing includes the steps of: (1) welding one end of the support member to a surface of the plate; and (2) welding an opposite end of the support member to the another surface of the angle member. The support member, in the preferred embodiment of the present invention, includes a first steel pipe and a second steel pipe. In particular, the step of affixing includes securing a bottom end of the first and second steel pipes to a surface of the plate, and securing a top end of the first and second steel pipes to the another surface of the angle member.

The step of installing a piling includes driving a plurality of pile segments into the earth for a desired depth directly below the fixture, and affixing the head onto a top of the plurality as pile segments. A cable is extended through the plurality of pile segments and through the head. A plate is positioned over the cable such that the plate resides on a top surface of the head. The plate is locked onto the top surface of the head by attaching a lock member onto the cable such that the plate is sandwiched between the lock member and the top surface of the head. In the method of the present invention, at least one shim can be positioned between a top of the pier and a bottom of the wall.

The present invention is also an apparatus for supporting a wall of a tilt wall construction. The apparatus comprises a pile having a head positioned at an upper end thereof, a support member having one end affixed to the head and extending upwardly therefrom, a fixture affixed to an opposite end of the support member, and a means for attaching the fixture to the wall. A plate can be affixed to a top surface of the head. The support has the one end affixed to the plate. This one end of the support member is welded to the plate so as to extend rigidly upwardly therefrom.

The fixture is an angle member having a first surface and a second surface extending in transverse relationship to the first surface. The support member is welded to the first surface of the angle member. The means for affixing, in the preferred embodiment of the present invention, is an anchor bolt extending through the second surface of the angle member. This anchor bolt is suitable for engagement with the wall such that the second surface of the angle member overlies a portion of the side of the wall. The support member includes a first steel pipe and a second steel pipe. Each of the first and second steel pipes have one end welded to the support and opposite ends being rigidly affixed to a plate positioned on a top surface of the head of the pile.

The foregoing Section is intended to describe, in generality, the preferred embodiment of the present invention. It is understood that modifications to this preferred embodiment can be made within the scope of the present invention. As such, this section should not be construed, in any way, as limiting of the broad scope of the present invention. The present invention should only be limited by the following claims and their legal equivalents.

DETAILED DESCRIPTION OF THE INVENTION

Figure 1:
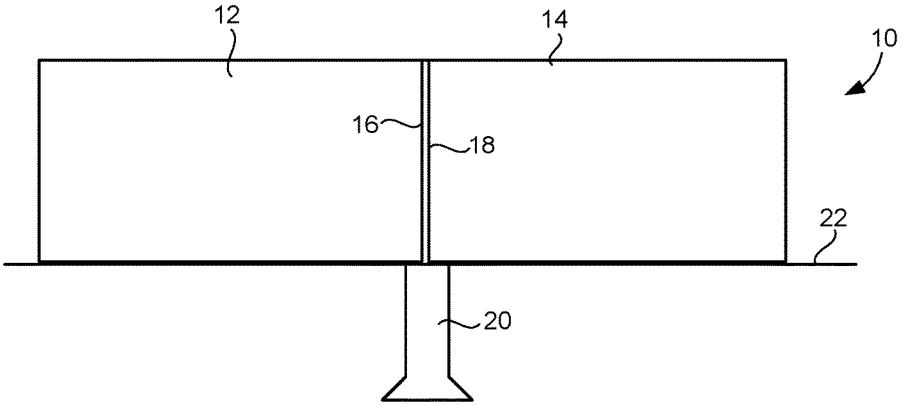
FIG. 1 PRIOR ART
FIG. 1 is a side elevational view of a prior art tilt wall construction.

FIG. 1 is an illustration of a prior art tilt wall construction 10. The tilt wall construction 10 includes a first wall 12 and a second wall 14. The first wall 12 has an end 16 adjacent an end 18 of the second wall 14. A pier 20 is positioned within the earth 22 in the area directly below the ends 16 and 18 of the respective walls 12 and 14. In normal use, the pier 20 is formed of concrete material and installed within the earth in a desired location such that the upper end of the pier 20 is generally adjacent to the surface of the earth 22.

Under normal circumstances, the pier 20 will sufficiently support the walls 12 and 14 in their desired orientation. However, if the pier 20 begins to sink in the earth 22 or the structure of the pier 20 begins to fail, the pier 20 will no loner support the weight of the walls 12 and 14 in the manner desired. If the pier 20 sinks, the ends 16 and 18 of the respective walls 12 and 14 will tend to creep together. As such, the walls 12 and 14 will move out of alignment. Once the walls 12 and 14 move out of alignment, extra stress is placed upon the roof structure which holds the walls 12 and 14 in their vertical orientation. Once the pier 20 begins to fail, extensive repair efforts were necessary in the prior art so as to insure the structural integrity of the tilt wall construction 10.

Figure 2:
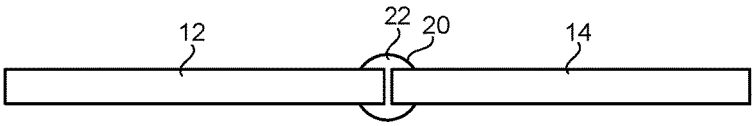
FIG. 2 PRIOR ART
FIG. 2 is a plan view of a prior art tilt wall construction.

FIG. 2 shows how the first wall 12 and the second wall 14 are supported upon the top 22 of the pier 20. The top 22 of the pier 20 has a circular construction and has a diameter which is wider than the width of each of the walls 12 and 14. The top 22 of the pier 20 bears against the bottom surface of the walls 12 and 14 so as to maintain the walls in their proper orientation.

Figure 3:
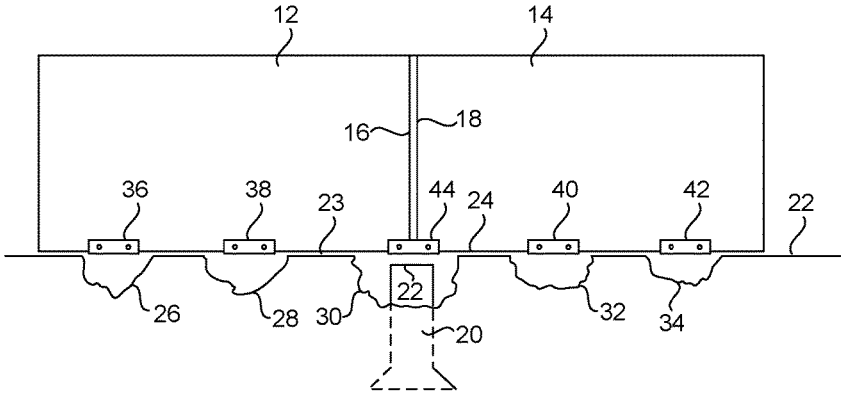
FIG. 3 is an illustration showing an early step in the method of the present invention for the repair of the tilt wall construction.

FIG. 3 shows an early step of the method of the present invention under those circumstances in which the pier 20 is beginning to fail or has failed. In particular, in FIG. 3, the pier 20 has sunk into the earth 22 for a distance beyond the bottom edge 23 of wall 12 and the bottom edge 24 of wall 14. As will be appreciated, before the implementation of the present invention, the ends 16 and 18 of the respective walls 12 and 14 will go out of parallel alignment.

Importantly, in the present invention, excavations 26, 28, 30, 32 and 34 are made in the earth adjacent to the respective bottoms 23 and 24 of the walls 12 and 14. Importantly, a fixture 36 is secured adjacent the bottom 23 of the wall 12. Another fixture 38 is also secured at the bottom 23 of the wall 12. A further fixture 40 is secured to the bottom 24 of the wall 14. Another fixture 42 is secured to the bottom 24 of the wall 14. Each of the fixtures 36, 38, 40 and 42 are in the nature of angle members which have a horizontal surface and a vertical surface. In FIG. 3, it can be seen that the vertical surface overlies a portion of the sides of the walls 12 and 14 generally adjacent to the respective bottoms 23 and 24. The horizontal surface will underlie the bottoms 23 and 24 of the respective walls 12 and 14. A suitable means for affixing is utilized so as to properly anchor the fixtures 36, 38, 40 and 42 in their proper positions at the bottoms of the walls 12 and 14. This "means for affixing" can take on a wide variety of configurations. In the preferred embodiment of the present invention, this "means for affixing" is in the nature of an anchor bolt that is affixed through a hole formed in the vertical portion of the fixtures. Alternatively, adhesives or epoxies, or other materials can be utilized so as to bond the surfaces of the fixtures 36, 38, 40 and 42 to the walls. Additionally, and further, this "means for affixing" could also include various types of latching mechanisms that secure such fixtures in place.

Access can be provided to the bottoms 23 and 24 of the respective walls 12 and 14 through the use of the excavations 26, 28, 32 and 34. As such, the fixtures 36, 38, 40 and 42 can be relatively easily installed, regardless of the alignment of the walls 12 and 14. In FIG. 3, the excavation 30 exposes the top surface 22 of the pier 20 along with the bottoms 23 and 24 of the respective walls 12 and 14. A bracket, fixture or plate 44 can be secured in the area between the ends 16 and 18 of the walls 12 and 14 and fastened thereto. As such, the fixture 44 can provide a bearing surface for supporting the end edges of the respective walls 12 and 14, in the manner to be described hereinafter.

Figure 4:
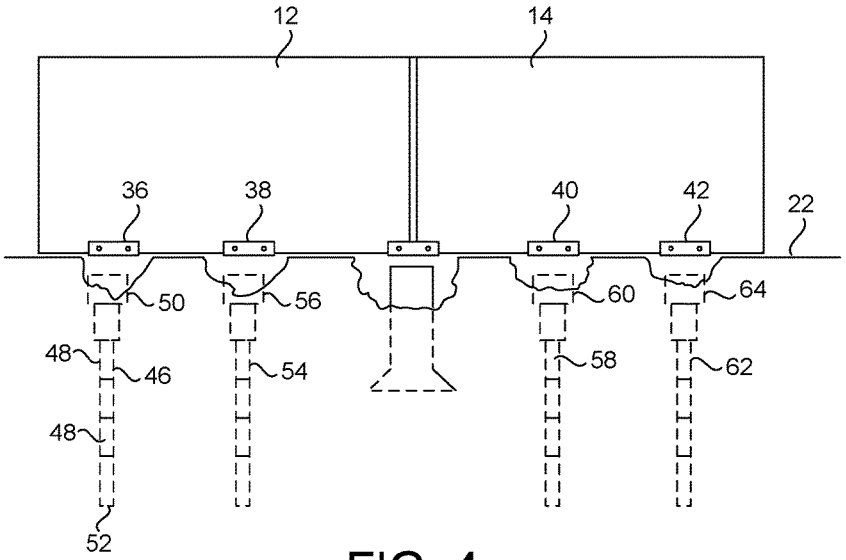
FIG. 4 is an illustration of a further step in the repair of the tilt wall construction in accordance with the present invention.

In FIG. 4, it can be seen that there is a piling 46 that has been driven into the earth 22 directly below the fixture 36. The piling 46 includes a plurality of pile segments 48 that are arranged in end-to-end relationship and in a stacked manner so as to extend through the earth. The piling 46 can be driven into the earth for a desired distance. Ultimately, the friction between the earth and the exterior surface of the pile segments 48 will create the requisite friction so as to support a head 50 of the piling 46 in an area generally adjacent to the fixture 36. In other circumstances, the bottom 52 of the piling 46 can rest upon bedrock, or other solid structures in the earth. As such, the piling 46 provides a proper support beneath the walls 12 and 14.

FIG. 4 also shows that piling 54 extends beneath the fixture 38. Piling 54 has a head 56 at an upper end thereof. A piling 58 is positioned directly below the fixture 40. Piling 58 has a head 60 at an upper end thereof. The piling 62 is driven into the earth directly below the fixture 42. Piling 62 also has head 64 at an upper end thereof. Each of the heads 50, 56, 60 and 64 provide a relatively large surface area upon which the support member of the present invention can serve to properly support the weight of the walls 12 and 14. Pilings 46, 54, 58 and 62 are driven into the earth by known techniques. Typically, a hydraulic jack will be placed against the respective fixtures so as to create a proper force so as to drive the pile segments 48 downwardly into the earth. The weight of the walls 12 and 14 can provide a proper ballast so as to properly achieve this hydraulic jacking of the pile segments into the earth. As will be described hereinafter, a cable will extend through the pile segments 48 of each of the pilings 46, 54, 58 and 62 so as to assure the proper vertical alignment of the pile segments.

Figure 5:
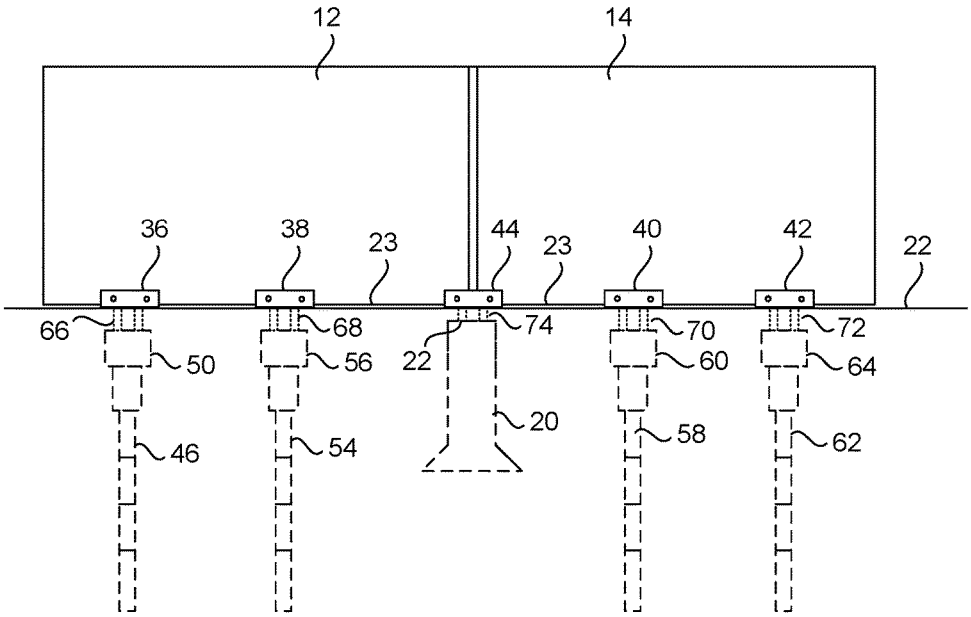
FIG. 5 is an illustration showing the completed repair of the tilt wall construction in accordance with the present invention.

FIG. 5 shows the completion of the repair of the walls 12 and 14 of the tilt wall construction 10. As can be seen in FIG. 5, a support member 66 extends above the top surface of the head 50 of piling 46. The support member 66 is in the form of a pair of steel pipes that have one end bearing against the top of the head 50 and an opposite end bearing against the horizontal surface associated with fixture 36.

Fixture 38 has support member 68 bearing thereagainst. Support member 68 extends between the head 56 of pile 54 and the horizontal surface associated with the fixture 38. The fixture 40 is supported by support members 70 extending between the head 60 of the piling 58 and the horizontal surface of the fixture 40. The fixture 42 bears against the support member 72. Support member 72 extends between the head 64 of the piling 62 and the horizontal surface of the fixture 42. It can be seen there is at least one shim 74 that is in place between the top surface 22 of the pier 20 and the horizontal surface of the fixture 44. Each of the excavations 26, 28, 32 and 34 (as shown in FIG. 3) has been filled in with earth so as to complete the repair of the tilt wall construction 10.

As can be seen in FIG. 5, the pilings 46, 54, 58 and 62 provide support along the entire length of the respective walls 12 and 14. The fixtures 36, 38, 40 and 42 distribute the force exerted by the respective supports 66, 68, 70 and 72 over a relatively wide area of the respective bottoms 23 and 24 of the walls 12 and 14. As such, a significant amount of weight has been removed from the failing pier 20. As a result, through proper jacking of the walls 12 and 14, the walls 12 and 14 achieve their desired orientation.

Figure 6:
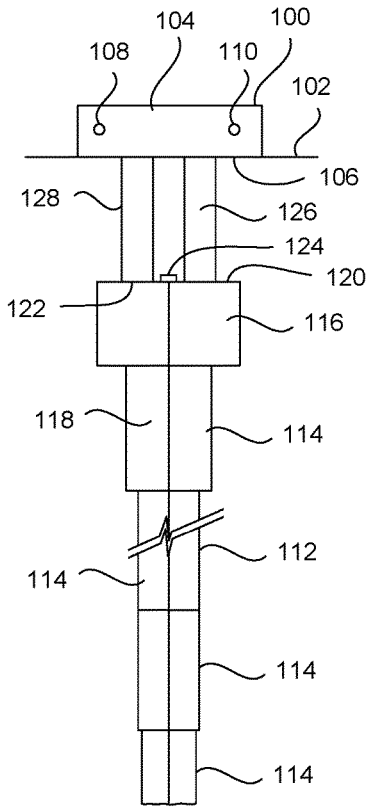
FIG. 6 is a side elevational view showing the apparatus used for the repair of the tilt wall construction in accordance with the teachings of the present invention.
Figure 7:
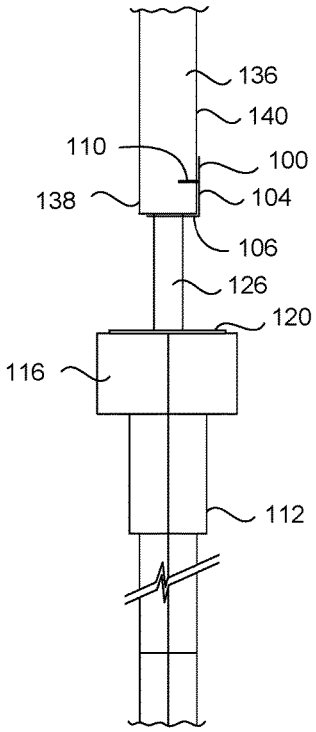
FIG. 7 is an end view showing the apparatus of the present invention for the repair of tilt wall construction.

It should be noted that the supports, 66, 68, 70 and 72 are in the form of steel pipes. In the preferred embodiment of the present invention, the upper end of the steel pipes is welded to the horizontal surface of the respective fixtures. Additionally, the bottom end of each of these steel pipes will be welded to a plate attached to the top surface of each of the heads 50, 56, 60 and 62. As such, the present invention effectively mechanically ties each of the walls 12 and 14 to the piles 46, 54, 58 and 62. Once the configuration of the repair of FIG. 4 is completed, the steel pipes associated with the supports 66, 68, 70 and 72 are cut or formed so as to be of a length equal to the distance between the top surface of the heads and the horizontal surface of the fixtures. The pipes will be cut at the work site so as to be of the proper length. Once a proper fit is achieved between the steel pipes of the supports and the plate associated with the heads of the piling and the horizontal surface of the fixtures is achieved, a proper welding of the pipes to the fixture and to the plate can be achieved. FIGS. 6 and 7 show this particular arrangement.

FIG. 6 shows, in particular, the configuration of the support apparatus of the present invention. In FIG. 6, it can be seen that the fixture 100 serves to receive the bottom 102 of the wall therein. The fixture 100 includes a vertical portion 104 and a horizontal portion 106. The horizontal portion 106 will underlie the bottom 102 of the wall. The vertical portion 104 will overlie a portion of the side of the wall at the bottom 102. Anchor bolts 108 and 110 will extend through the vertical portion 104 of the fixture 100 so as to rigidly affix the vertical portion 104 of the fixture 100 to the surface of the side of the wall.

The piling 112 includes a plurality of pile segments 114 which are arranged in stacked relationship. A head 116 is positioned at the top of the plurality of pile segments 114. A cable 118 will extend through the interior of the pile segments 114 in either a tensioned or untensioned relationship. As such, the cable 118 assures a proper alignment of the pile segments 114 in a vertical orientation.

A steel plate 120 is positioned at the top surface 122 of the head 116. A lock 124 is affixed to the cable 118 so as to sandwich the plate 120 between the top surface 122 of the head 116 and the lock mechanism 124. This lock mechanism 124 can be a SURELOCK™ that is sold by Cable-Lock, Inc. In this manner, the plate 120 is permanently and securely affixed to the top surface 122 of the head 116 of piling 112.

A first pipe 126 and a second pipe 128 are positioned between the plate 120 and the horizontal portion 106 of the fixture 100. It can be seen that the upper ends of the pipes 126 and 128 are welded to the horizontal surface 106. The bottom ends of the pipes 126 and 128 are welded to the top surface of the plate 120. As such, the wall will be rigidly tied to the piling 112.

FIG. 7 shows a side view of the apparatus of the present invention. In FIG. 7, the wall 136 is illustrated. Wall 136 has a bottom 138. The fixture 100 is secured to the side 140 of the wall 136 through the use of an anchor bolt 110. The horizontal portion 106 of the fixture 100 is positioned against the bottom 138 of the wall 136. Although an angle member is illustrated as being the fixture 100, it is possible that various other structures could be utilized in the present invention. For example, a channel member could also be used as the "fixture". Furthermore, it is possible that a plate at the bottom 138 of the wall 136 could also suffice if the plate were secured rigidly to the bottom of the wall 136. However, the angle member shape of the fixture 100 is the preferred embodiment of the present invention since the vertical surface 104 of the angle member will serve as an alignment device for the walls.

FIG. 7 shows that the pipe 126 is welded at its upper end to the horizontal surface 106 of the fixture 100. The bottom end of the pipe 126 is welded to the top surface of the plate 120. The plate 120 rests on the top surface of the head 116. The piling 112 supports the head 116 in a desired position.

The method of the present invention allows for the repair of the tilt wall construction in a convenient and effective manner. The walls are properly returned to their desired orientation. The weight of the walls on the failing pier is significantly removed from the failing pier. A substantial portion the weight of the wall is entirely supported by the relationship of the fixture and the pilings. The apparatus can be particularly shaped so as to fit the desired configuration of the tilt wall construction. The use of the various fixtures located along the bottom edges of the each of the walls assures a proper planar alignment of the walls. Each of these fixtures allows proper forces to be applied thereto without damaging any structure of the wall. As such, the tilt wall construction can be easily returned to its desired configuration.

The foregoing disclosure and description of the invention is illustrative and explanatory thereof. Various changes in the details of the illustrated construction or in the steps of the described method can be made within the scope of the appended claims without departing from the true spirit of the invention. The present invention should only be limited by the following claims and their legal equivalents.

I claim:

1. A method of repairing a tilt wall construction, the tilt wall construction having at least one wall supported by a pier in the earth, the method comprising:

affixing a fixture at a bottom of the wall;

installing a piling into the earth directly below said fixture, said piling having a head at an upper end thereof, the step of installing a piling comprising:

driving a plurality of pile segments one upon another into the earth for a desired distance directly below said fixture; and affixing said head onto a top of said plurality of pile segments;

forming a support member having a length corresponding to a distance between said fixture and said head of said piling; and affixing said support member to said fixture and to said head such that said piling supports the wall.

2. The method of claim 1, said fixture being an angle member, the method further comprising:

anchoring said angle member to the wall such that one surface of the angle member overlies a portion of a side of the wall adjacent the bottom of the wall and such that another surface of the angle member underlies a portion of the bottom of the wall.

3. The method of claim 2, further comprising:

affixing a plate onto a top surface of said head said piling.

4. The method of claim 3, said piling having a cable extending therethrough, said plate being affixed by a locking member secured to said cable.

5. The method of claim 3, the step of affixing comprising:

welding one end of said support member to a surface of said plate; and welding an opposite end of said support member to said another surface of said angle member.

6. The method of claim 3, said support member comprising a first pipe and a second pipe, the step of affixing comprising:

securing a bottom of said first and second pipes to a surface of said plate; and securing a top end of said first and second pipes to said another surface of said angle member.

7. The method of claim 1, further comprising:

extending a cable through said plurality of pile segments and through said head;

positioning a plate over said cable such that said plate resides on a top surface of said head; and locking said plate onto said top surface of said head by attaching a lock member onto said cable such that said plate is sandwiched between said lock member and said top surface of said head.

8. The method of claim 1, further comprising:

positioning at least one shim between a top of the pier and a bottom of the wall.

9. A method of repairing a tilt wall construction, the tilt wall construction having a first wall and a second wall supported by a pier in the earth, the method comprising: excavating the earth in a first area below the first wall in a location away from the pier; excavating the earth in a second area below the second wall in a location away from the pier; affixing a first fixture at a bottom of the first wall at the first area; affixing a second fixture at a bottom of the second wall at the second area; installing a first plurality of pile segments into the earth directly below said first fixture, said first plurality of pile segments having a head at an upper end thereof; installing a second plurality of pile segments into the earth directly below said second fixture, said second plurality of pile segments having a head at an upper end thereof; forming a first support member having a length corresponding to a distance between said first fixture and said head of said first plurality of pile segments; forming a second support member having a link corresponding to a distance between said second fixture and said head of said second plurality of pile segments; affixing said first support member to said first fixture and to said head of said first plurality of pile segments such that said first plurality of pile segments supports the first wall; and affixing said second support member to said second fixture and to said head of said second plurality of pile segments such that second first plurality of pile segments supports the second wall.

10. The method of claim 9, each of said first fixture and said second fixture being an angle member, the method further comprising:

anchoring said angle member to the wall such that one surface of the angle member overlies a portion of a side of the wall adjacent the bottom of the wall and such that another surface of the angle member underlies a portion of the bottom of the wall.

11. The method of claim 10, further comprising:

affixing a first plate onto a top surface of said head of said first plurality of pile segments; and affixing a second plate onto a top surface of said head said second plurality of pile segments.

12. The method of claim 11, the step of affixing said first support member comprising:

welding one end of said first support member to a surface of the plate; and welding an opposite end of said first support member to said another surface of the angle member.

* * * * *